United States Patent [19]

Busch

[11] 4,114,521

[45] Sep. 19, 1978

[54] VENTILATION METHOD AND SYSTEM FOR PROTECTING SHOOTERS FROM POLLUTANTS

[75] Inventor: Theodore N. Busch, Minneapolis, Minn.

[73] Assignee: Caswell Equipment Co., Minneapolis, Minn.

[21] Appl. No.: 831,487

[22] Filed: Sep. 8, 1977

Related U.S. Application Data

[63] Continuation-in-part of Ser. No. 706,582, Jul. 19, 1976, abandoned.

[51] Int. Cl.[2] ..... F24F 9/00

[52] U.S. Cl. ..... 98/36; 98/115 SB; 118/326; 55/DIG. 29; 35/25

[58] Field of Search ..... 98/36, 115 SB; 35/25; 55/DIG. 29, DIG. 18, 385 A; 118/326, 634, DIG. 7; 89/1 E

[56] References Cited

U.S. PATENT DOCUMENTS

| | | | |
|---|---|---|---|
| 2,257,516 | 9/1941 | Roche, Jr. et al. | 98/115 SB |
| 2,775,187 | 12/1956 | McClurkin | 98/36 |
| 3,270,655 | 9/1966 | Guirlet et al. | 98/36 |
| 3,303,839 | 2/1967 | Tavan | 55/DIG. 29 |
| 3,350,994 | 11/1967 | Guibert | 98/36 |
| 3,421,290 | 1/1969 | Cheney et al. | 98/1 |
| 3,802,099 | 4/1974 | Mell et al. | 273/101.1 |
| 3,860,236 | 1/1975 | Buchanan | 98/36 |

*Primary Examiner*—John J. Camby
*Assistant Examiner*—Henry C. Yuen
*Attorney, Agent, or Firm*—Schroeder, Siegfried, Ryan, Vidas & Steffey

[57] ABSTRACT

An improved ventilation method and ventilation system for shooting ranges in which the conventional ventilation system of the shooting range is supplemented by the addition of air in the shooting stall intermediate the shooter's face and weapon. Preferably, the direction of the supplemental air flow is at an angle to the shooter and toward the target area to remove contaminants away from the shooting stall and downrange of the shooter.

10 Claims, 4 Drawing Figures

VENTILATION METHOD AND SYSTEM FOR PROTECTING SHOOTERS FROM POLLUTANTS

This application is a continuation-in-part of my application Ser. No. 706,582 filed July 19, 1976, now abandoned.

My invention relates to a ventilation of shooting range of the indoor type and more particularly to an improved method and system of ventilating indoor shooting ranges to prevent toxic materials generated by firing of the weapon from reaching the shooters. While it will be described in the environment of an indoor range, it should be understood that it is applicable to outdoor ranges as well.

Conventionally, the ventilation of indoor shooting ranges, has been designed to remove toxic materials generated by fire arm discharge from ingestion by the shooter and spectators. These toxic materials include the combustion gases from the burning of the powder and also include particulate lead particules and vaporized lead. For purposes of this specification when the terms contaminants, pollutants or toxic gases are used, they include both gases and lead particles.

In gallery type ranges in indoor ranges, health problems to shooters as a result of such toxic gases have been recognized for years. A prior art conventional method of ventilation to protect the shooter has been to draw air from space behind the shooter toward the target area of the range. In some instances to hold down the cost of heating or cooling, the air is collected at the target area, filtered and recirculated and discharged in the area behind the shooter's stalls. The interest of such systems is to circulate air away from the shooter and toward the target area. However, despite the intention of such prior systems, I have found that the tubulence created by the shooter's body in the stall and the stalls themselves creates a problem of back draft of the pollutants from firing of the weapon into the region of shooter's face and breathing area. An increase in air velocity in the circulating system has not remedied this problem, but rather tends to worsen it by increasing the area and extent of turbulence.

The present invention is directed to an improved method of ventilation which provides for introducing air supply into the region of the shooting stall which directs a stream of clean air intermediate the shooter's face and his weapon, thus, diluting and carrying away the contaminants resulting from firing of the weapon. In the preferred form, air is introduced adjacent the shooter's head on one or both sides of the shooting stall through diffusers therein. The air stream may also be introduced above or below his head or in any combination of these positions to move the pollutants caused by firing of the weapon away from the shooter and into the overall ventilation system air stream. The air introduced may be from the general air circulation system with intermediate pressurizing means to increase the pressure thereof or may be fresh pressurized air. The preferred form of the improved system utilizes diffusers on the walls of the shooting stall with jets directed so as to cause air movement away from the shooter at a flow rate which exceeds the normal air flow in the range by a ratio of at least 2 to 1 to carry away gases resulting from operation of the weapon.

It is therefore an object of this invention to provide an improved method of ventilation of shooting ranges.

Another object of this invention is to provide an improved system of ventilation for shooting ranges.

A still further object of this invention is to provide an improved arrangement for discharging air from the shooting stall between the shooter's face and the weapon to carry away the contaminants resulting from operation of the weapon by a shooter.

These and other objects of this invention will become apparent from the reading of the attached description together with the drawings wherein.

Figure 1:
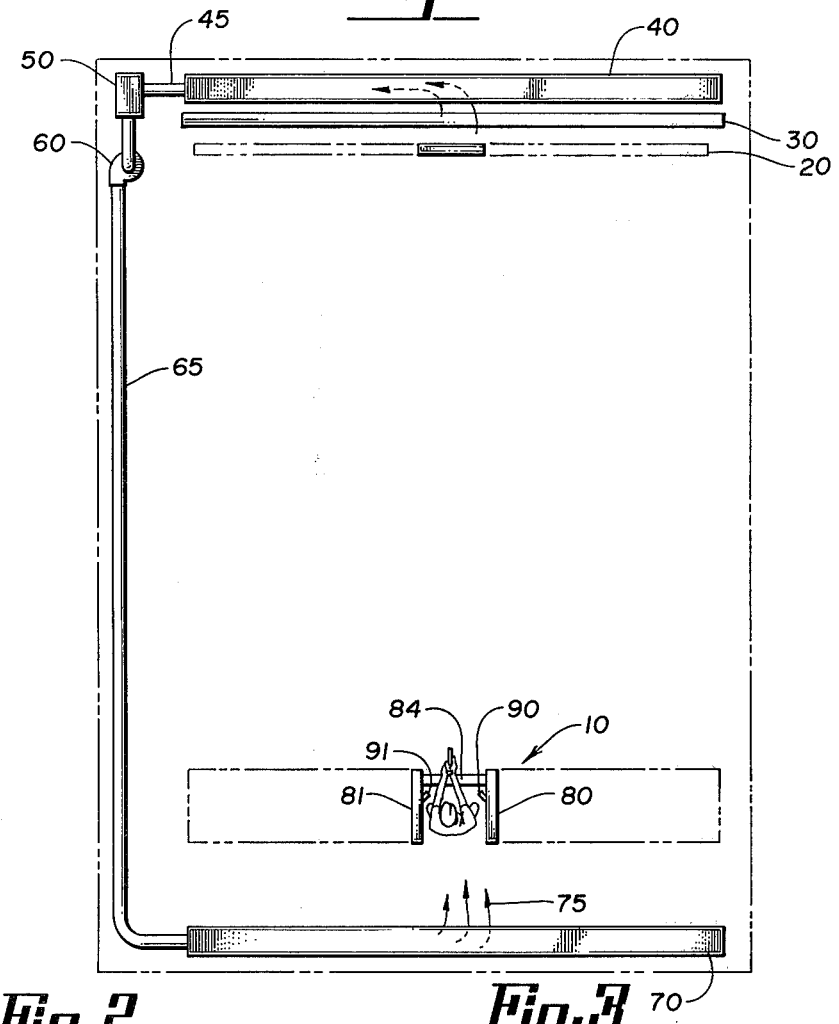
FIG. 1 is a schematic diagram of a shooting range showing the ventilation system in block form.

In FIG. 1, there is shown diagramatically an indoor type shooting range and the ventilation system for the same. It will be understood that such ranges are enclosed and for the purpose of removing pollutants such as toxic gases resulting from operation of weapons in the area, a special ventilation system is required. Thus, in FIG. 1, the shooting range is defined as inincluding one or more shooting stalls, indicated generally at 10, positioned at one end of the enclosure shown schematically by dotted lines, and aligned with a target area or target portion 20 with a suitable impact or bullet collecting area 30. The ventilation system for this type of shooting range normally includes an intake or air return manifold 40 positioned in the target and impact areas which is connected by suitable duct work indicated schematically at 45 to a filter section 50, positioned ahead of an air circulation means, such as a blower 60. The output of the blower is connected through a duct 65 to an air discharge manifold, indicated generally at 70, which in some installations takes the form of a plurality of diffusers intended to provide a laminar air output flow therefrom such as is indicated by the arrows 75. This normal air flow is normally in the range of 50 - 100 ft/min and is tempered for comfort conditions in the range. The discharge is located at the opposite end of the enclosure from the bullet impact and collecting area 30 and behind the shooting stalls or stall. Thus, the air movement from the discharge manifold or diffuser 70 is through the enclosure of stall 10 and down the range past the target area 20 to the impact area 30 where the return manifold 40 collects the air and any contaminants and circulates the same through filters 50 to clean out the contaminants.

As shown in dotted lines, it will be understood that there will typically be a plurality of stalls in the shooting gallery, each defined by the area between opposing walls sections 80, 81 which conventionally include such a shelf 84 behind which the shooter would stand or be positioned in the firing operation. Such shelf may be removable or fold up if it is desired to employ a plurality of shooting positions from the stall. Thus, the position in which the shooter stands, kneels, sits, or lies, is defined as the shooting area within the stall and the weapon is typically positioned at the forward end of the stall or in some cases slightly forward of whatever barrier might be employed. Thus, any gases and other pollutants emanating from the barrel of the weapon or the chambers of revolver or pistol is typically toward the forward edge of or even downrange of the stall.

In the conventional shooting range of the type just described in the body of the shooter in the stall deflects a certain amount of air flow from a discharge or diffuser 75 such that certain turbulant areas are created intermediate the shooter and his weapons muzzle. Gases and pollutants emanating from the weapon upon firing tend to be brought back into the vicinity of the shooter's face and mouth due to the air turbulance created by his body in the conventional air flow pattern.

Recognizing this problem, the present invention utilizes the addition of separate air flow at the shooter's stall at a higher velocity than the normal air flow at least in the ratio of 2 to 1 to normal air flow. This separate airflow is directed from in front of the shooter and preferrably away from him downrange such that the air flow tends to take any gases or contaminants emanating from the discharge weapon and cause the same to be directed downrange away from the shooter. In addition, the additional flow of air tends to dilute any toxic gaseous contaminants and prevent the backflow of the same by air turbulence back toward the shooter. To accomplish this end, the walls of the shooting stall have positioned either thereon or therein supplemental diffusers 90 and 91. These diffusers may project from or be positioned flush into the sides of the stall 10 and preferrably oriented to direct air at an angle in front of the shooter, such as to direct the airflow beyond the barrier 84 of the stall and preferrably intermediate the face of the shooter and the weapon being discharged. The diffusers may be positioned on one wall of the stall or on both walls of the stall and preferrably directs the air therefrom. The nozzles may also be directed such that they may create an air flow at an angle to the shooter directing the flow from above and/or below the shooter's face and away from the same. Any combination of locations of diffusers or nozzles may be utilzied to accomplish this purpose. It is also possible to use the air flow in the shooter's stall as the sole source of ventilation in the range or as a separate air source over and above the normal air flow from non-laminar diffusers of the typical building types which has a pressure to create a flow of at least twice that of the normal air flow.

The main concept of the invention is to provide a supplemental air flow of sufficient velocity intermediate the shooter's face and weapon which will direct the pollutant away from the shooter and will decrease the risk of bringing pollutants to a point where they will be inhaled by the shooter. In main ventilator systems of the prior art as has been described, the adverse effect of the turbulence due to the body of the shooter and the stall is substantially overcome by the supplemental air flow and the return of any pollutant material into the vicinity of the shooter is lessened and substantially eliminated. In addition, the jet stream or flow from the supplemental air source will tend to dilute any contaminants and urge the same downrange toward the target area where they will be picked up by the return manifold 40.

Figure 2:
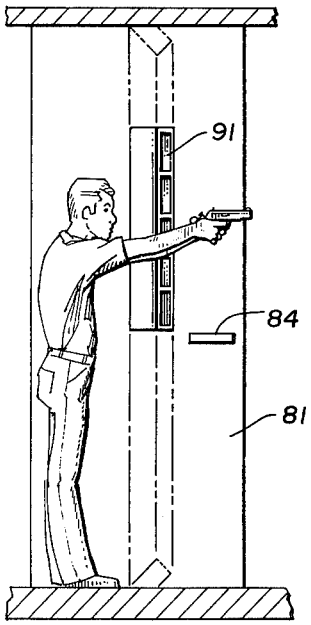
FIG. 2 is an elevation view of the wall of the shooting stall showing th discharge nozzles therein.

In FIG. 2, the diffusers are shown on one side wall 81 as a set of nozzles 91 or an elongated nozzle which may extend only in the vicinity of the upper portion of the shooter's body and extend the full height of the stall. Each of the stalls in the range would have similar supplemental air diffusers to accomplish the same purpose of effectively keeping of any contaminants from around the respiratory orifices of the shooter regardless of whether he is in a standing, kneeling, sitting or prone position.

Figure 3:
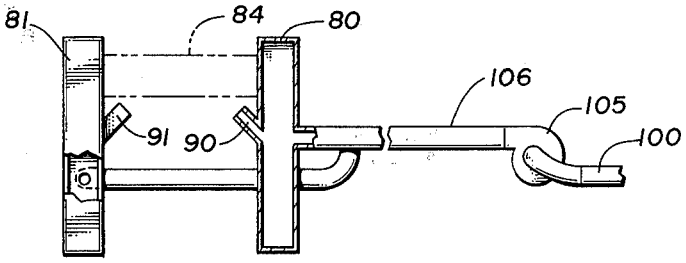
FIG. 3 is a schematic diagram of a stall showing one embodiment of the source of supplemental air for the ventilation system; and, FIG. 4 is a schematic diagram of the stall showing an alternate embodiment of the source of supplemental air for the ventilation system.

FIG. 3 shows schematically the source of supplemental air as one embodiment for providing the same for the ventilation system. Thus, in FIG. 3, the conduit 100 is to indicate the conduit to an outside air source with a suitable air circulator or blower 105 drawing the air into the same and directing it through a conduit 106 under pressure to the interior of the walls 80, 81 which are hollow. The diffusers associated therewith will provide the outlet of the air in the shooting stall. A separate manifold, rather than hollow walls, may be utilized for this purpose. A typical air flow from the diffusers that has been found satisfactory is from 100–200 cfm.

Figure 4:
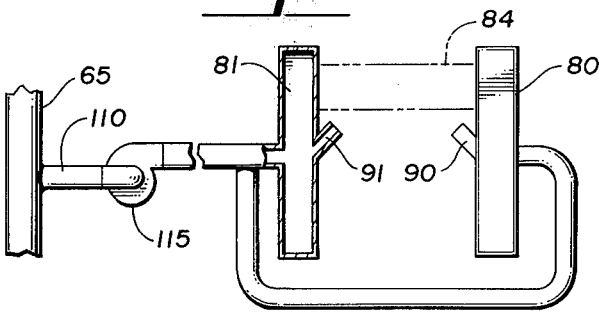

In FIG. 4, the supplemental air may be supplied from the recirculated air stream such as a tap off of the conduit 65 through a conduit 110 and a suitable booster blower 115 leading to a separate manifold at the stall or in the interior of the walls 80, 81 as the manifold which will supply air to the diffusers or jets 90, 91 at the higher pressure.

Therefore, in conjunction with ranges providing a general airflow from behind the shooter towards the target, my invention consists in introducing supply air ahead of the shooter's face and prior to the gun muzzle to counteract the turbulent air flow that the stall and his head and body causes. While this supplemental air does not necessarily reduce the turbulence, it does carry the toxic matter away from the shooter, and does dilute the contaminants, thereby decreasing the risk poisoning a shooter.

What I claim is:

1. A shooting stall for shooting ranges having a target area at one end of the same at which a weapon is to be fired and having a normal air flow substantially from the shooting stall toward the target area comprising: at least a pair of spaced and parallel side walls adapted to be mounted in a shooting range remote from the target area, said walls defining a shooter position; and an air discharge structure positioned in each of the side walls of the shooting stall, said air discharge structure being adapted to be connected to a source of air under pressure and being oriented in the shooting stall for directing a stream of air generally transverse to the normal air flow toward the target area intermediate a shooter in the shooting stall and toward the discharge portion of the weapon held by the shooter when the shooter fires from a shooting position, said stream of air having a rate of flow at least in the ratio of 2 to 1 with the normal air flow toward the target area to direct contaminants away from the shooter.

2. The shooting stall of claim 1 in which the air discharge structure includes the discharge vents directed generally away from the shooting position and angled toward the target area.

3. The shooting stall of claim 2 in which the discharge structure is positioned in opposing walls of the shooting stall.

4. The shooting stall of claim 3 in which the discharge vents are positioned in elongated and vertical arrangement along the extent of the side walls.

5. The shooting stall of claim 1 in which the side walls of the shooting stall are hollow and form a chamber for receiving air under pressure and said discharge vents are positioned therein in an elongated, vertically oriented array.

6. A shooting stall in accordance with claim 1 wherein said discharge structure is positioned such that the transverse stream of air is at least slightly angled toward the target area.

7. In a ventilation system of indoor shooting ranges having a target area at one end thereof at which a weapon is fired and a normal air flow from behind the shooting stall in the range toward the target area wherein a general ventilation system providing the normal air flow includes a air intake means adjacent the target end of the range and air discharge means rearwardly of the shooting stall for directing the stream of normal air toward said air intake to convey pollutants away from the shooting area, the improvement comprising supplemental air discharge means positioned in said shooting stall to interject streams of air from opposite sides of the stall generally transverse to the normal air flow toward the target area and at a flow rate in the ratio of 2 to 1 to the normal air flow intermediate the shooter's face and the discharge end of its weapon when being fired, and air supply means for providing air under such pressure to produce such flow rate to the supplemental discharge means.

8. A ventilation system in accordance with claim 7 wherein the general ventilation system is a closed system having a duct means joining said intake and discharge means, said duct means including blower and filter means, and said air supply means includes a separate fan and duct assembly joined to said duct means for removing a portion of the air from said duct means on the downstream side of filter means.

9. A ventilation system in accordance with claim 7 wherein said air supply menas is joined to a fresh source of air.

10. The method of reducing the hazard of a shooter absorbing the pollutants resulting from the discharge of his weapon in an indoor shooting range having shooting stalls, a target area at which a weapon is fired and a normal air flow substantially from the shooting stalls toward the target area comprising, providing air jet means in said stall positioned for interjecting streams of air from opposite sides of the stall intermediate the shooter's face and the discharge part of his weapon when being fired, and blowing a stream of fresh air through said jets generally transverse to the airflow toward the target area at a rate at least twice that of the normal air flow.

* * * * *